United States Patent [19]

Gartshore et al.

[11] 4,103,821

[45] Aug. 1, 1978

[54] SHIPPING ENVELOPE

[75] Inventors: Peter A. Gartshore; James O. Ward, both of Portland, Oreg.

[73] Assignee: Pak-Well Corporation, Denver, Colo.

[21] Appl. No.: 818,119

[22] Filed: Jul. 22, 1977

[51] Int. Cl.[2] ..... B65D 27/00

[52] U.S. Cl. ..... 229/74; 40/10 B; 53/14

[58] Field of Search ..... 229/74, 62, 80; 40/10 B, 10 D; 150/7; 206/806, 813; 53/14

[56] References Cited

U.S. PATENT DOCUMENTS

| | | | |
|---|---|---|---|
| 2,099,303 | 11/1937 | Hohwart | 229/80 |
| 2,861,735 | 11/1958 | Faltin | 229/62 X |
| 2,925,675 | 2/1960 | Lumpkin | 40/10 D |
| 3,250,385 | 5/1966 | Timms | 229/74 X |
| 3,327,416 | 6/1967 | Sanford | 229/74 X |
| 3,330,471 | 7/1967 | Timms | 229/74 |
| 3,525,470 | 8/1970 | Carrigan | 229/74 |

*Primary Examiner*—Stephen P. Garbe

*Attorney, Agent, or Firm*—Sheridan, Ross, Fields & McIntosh

[57] ABSTRACT

The shipping envelope comprises a forward panel and a rear panel closed along their side edges and a first bottom edge, with their second opposite edges free of each other to provide access to the interior. Each panel has an interior face and an exterior face, the forward panel being longer than the rear panel to form a foldable flap. Adhesive is applied to the exterior face of the flap and to the exterior face of the rear panel except for the marginal edges, and release sheets cover the adhesive areas. In use, the release sheet is first removed from the rear panel and the latter is pressed against a package to attach the envelope in place. One or more shipping documents may be inserted in the mounted envelope at the same or different times with the marginal edges of the rear panel allowed to bend upward to allow the envelope to accomodate the thickness of the documents. Thereafter the flap is folded under the mouth of the envelope to serve as a closure and with the release shut removed the adhesive exterior face is pressed against the package to complete the sealing and mounting of the documents.

5 Claims, 6 Drawing Figures

SHIPPING ENVELOPE

BACKGROUND OF THE INVENTION

The device of this invention lies in the field of envelopes for shipping documents or other items which are to be transported within packages or containers. It more specifically applies to envelopes which can be attached to containers which can easily receive documents as the container is filled and easily opened at its destination.

Many different types of shipping envelopes have been developed and used with varying degrees of success and with various disadvantages and difficulties.

In one prior art form an envelope is made up of two sheets of transparent plastic material secured together along sides and one end, the front panel being somewhat longer than the back panel. The excess length of the front panel is coated with pressure sensitive adhesive on its rear face and the back panel is similarly coated, with sheets of release material protecting the adhesive and preventing premature sticking. In use, the shipping documents are placed in the envelope, preferably with an address showing through the front panel, the release sheets are removed, and the envelope and the flap extending outward are pressed against the package to secure it in place. The only seal of the envelope opening is the adhesion of the envelope and flap to the surface of the container. Examples of this form are shown in U.S. Pat. Nos. 3,327,416 to Sanford and 3,525,470 to Carrigan.

Other forms include a gummed paper frame overlying the margins of a letter or envelope and secured all around to a carton, as shown in U.S. Pat. No. 3,159,130 to Allen.

With the first type, one or more documents are placed in the envelope and thereafter it is secured to the carton. If the carton or crate is large, and parcels are placed in it at separate times, the envelope must be kept loose, but handy somewhere nearby to receive documents from time to time until the package is filled, after which the envelope is secured to the package. Because it is sealed to the package all around, it is quite difficult to remove or open at the destination. The other forms require accurate centering of the frames or sheets over the papers and are similarly difficult to open or remove at the destination.

What is needed is a shipping envelope which may be secured to a carton while still empty to prevent misplacement and with an open and free marginal edges to allow a plurality of papers to be inserted from time to time as the carton is gradually filled, together with a flap which may be folded under the mouth to secure the contents and then itself sealed to the surface of the carton. In addition, the envelope should be easy to open upon arrival at the destination.

SUMMARY OF THE INVENTION

The device of the present invention overcomes the difficulties and disadvantages mentioned above and provides a shipping envelope which may be secured to a package in advance, with papers placed therein from time to time until the package is complete, and finally sealed against loss of the papers and secured completely to the package.

Generally stated, the device comprises a forward panel and a rear panel closed along their side edges and a first bottom end edge with their second ends free of each other to provide access to the interior. Each panel has an interior face and an exterior face, and the forward panel is longer than the rear panel to form a foldable flap. Adhesive is applied to an area of the exterior face of the flap and to a major area of the exterior face of the rear panel except for the marginal edges. The second end portion being free of adhesive throughout the area over which the flap will lie, except for the portion adjacent to the side edges of the flap. Release sheets are applied to protect the adhesive areas against inadvertent sticking. In use, the release sheet is removed from the rear panel, and the rear panel adhesive is pressed against the surface of the package to attach the envelope in place. Various papers may now be inserted in the envelope from time to time as the package is gradually filled, with no need to keep the envelope in a file or on a desk where it may be mislaid or some of the contents lost. When the last document is inserted, the release sheet is removed from the flap, which is folded under the mouth of the envelope to secure the contents, and the adhesive exterior face of the flap is pressed against the package to complete the sealing and mounting of the papers. When the package reaches the destination a cutting instrument may be readily inserted between the folded edge of the flap and the rear panel to sever the flap along the fold line.

The adhesive is omitted from the margins of the exterior face of the rear panel to allow the edges to be raised upward from the surface of the container to allow the envelope to increase in thickness to receive a plurality of documents. In addition, adhesive can be omitted from the portion of the flap near the fold so that the envelope can be more easily opened by pushing in on the folded edge to bulge or curl the flap edge for insertion of an opening instrument.

BRIEF DESCRIPTION OF THE DRAWINGS

Various other advantages and features of novelty will become apparent as the description proceeds in conjunction with the accompanying drawings, in which.

DESCRIPTION OF PREFERRED EMBODIMENTS

Figure 1:
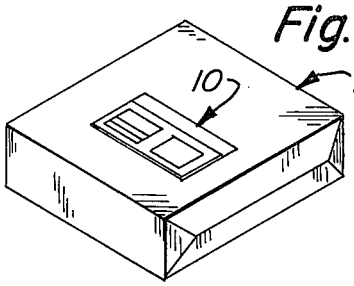
FIG. 1 is a perspective view of a typical carton or package on which the envelope is mounted.
Figure 2:
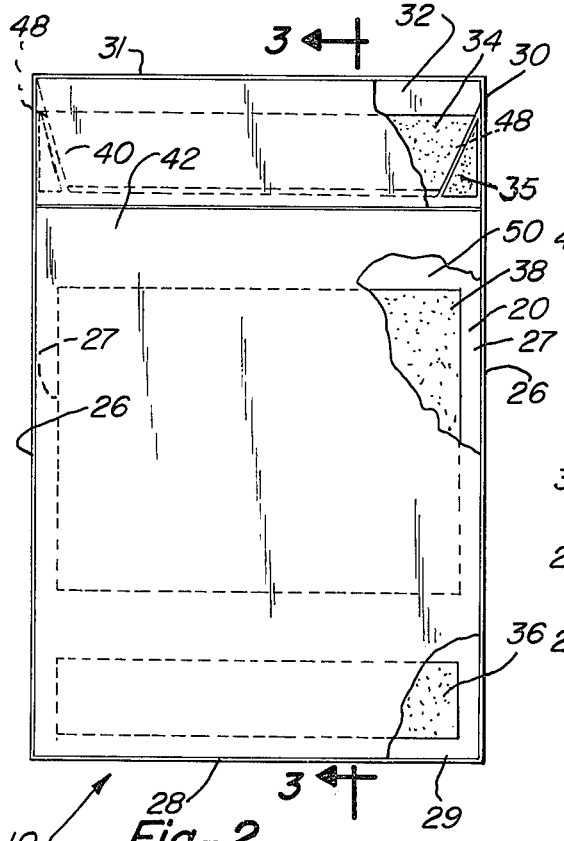
FIG. 2 is a rear elevational view of the envelope.
Figure 3:
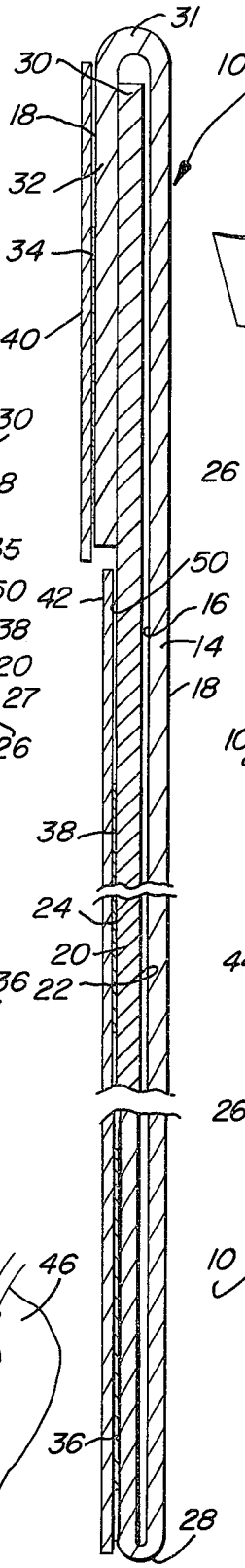
FIG. 3 is a sectional view taken on line 3—3 of FIG. 2.
Figure 4:
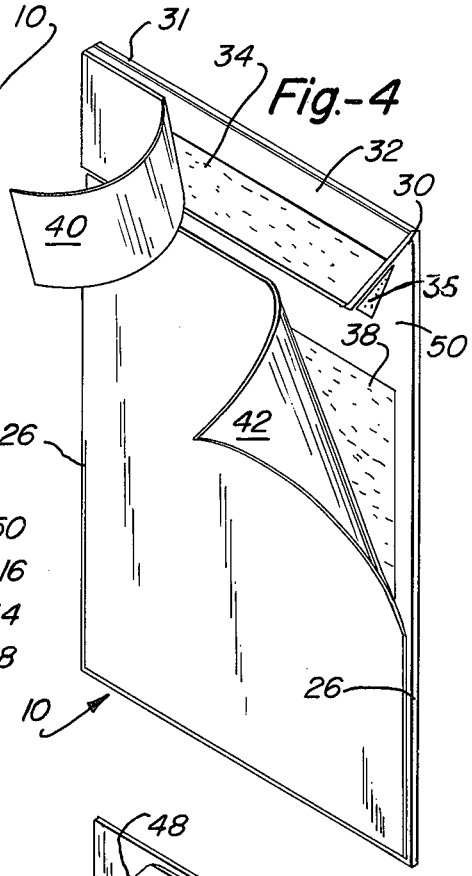
FIG. 4 is a rear perspective view of the envelope with the release sheets partially peeled away to show the adhesive areas.

The envelope of the present invention is schematically illustrated in FIG. 1 in mounted position on a package and in FIGS. 2 and 3 in detail, in which the envelope 10 is secured in shipping condition on a package 12 with the destination and other label information displayed in full view.

The envelope includes a forward panel 14 having an interior face 16 and an exterior face 18, and a rear panel 20 having an interior face 22 and an exterior face 24. The panels are secured to each other along the side edges 26 and a first bottom end edge 28, with the second end 30 of panel 20 free of panel 14 to provide access to the interior of the envelope. The forward panel 14 is longer than the rear panel 20, and the excess length constitutes a flap 32 which may be folded along fold edge 31 down over the mouth of the envelope to serve at a closure and safely retain any contents of the envelope.

A layer of pressure sensitive adhesive 34 is applied to an area of the exterior face 18 of flap 32 and a similar layer of adhesive is applied to a major area of the exterior face 24 of rear panel 20. Small areas 35 of adhesive are also applied to the exterior face 24 of rear panel 20 adjacent each side edge of the flap 32. The adhesive on panel 20 does not cover the entire panel including the marginal areas, and may be in the form of two or more areas 36 and 38. No adhesive is applied to the second end portion 30 of panel 20 under which flap 32 will lie in folded position. Release sheets 40 and 42 are detachably secured to the adhesive areas to protect them against dirt and sticking to foreign objects until they are ready to be secured to the package.

Figure 5:
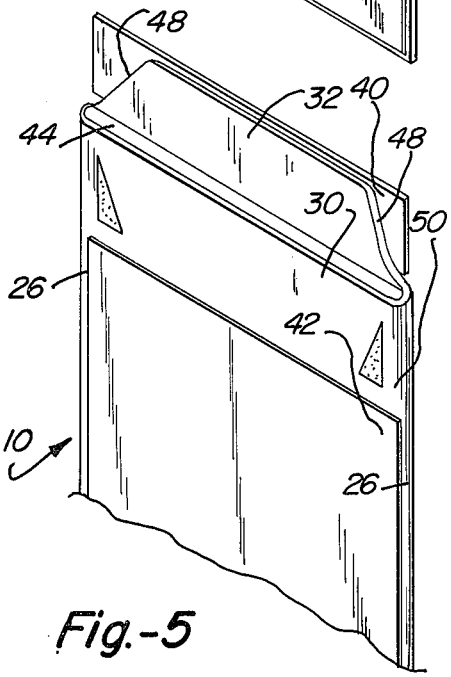
FIG. 5 is a rear perspective view of the envelope with the flap opened.

When the envelope is about to be utilized, the release sheet 42 is peeled off and panel 20 is applied to the surface of the package, pressing it firmly to cause it to adhere. The flap 32 is in the open or extended position as shown in FIG. 5 and its release sheet 40 is still in place but the small adhesive areas 35 are now exposed. Consequently, various documents may be inserted in the envelope through open mouth 44 from time to time as corresponding articles are placed in the carton or package. When the loading is completed, release sheet 40 is peeled off, flap 32 is folded over and under mouth 44 and between areas 35 joined to the package surface, and the upper end of the envelope is pressed firmly against the surface of the package to lock the contents in the envelope and secure the latter to the package.

Figure 6:
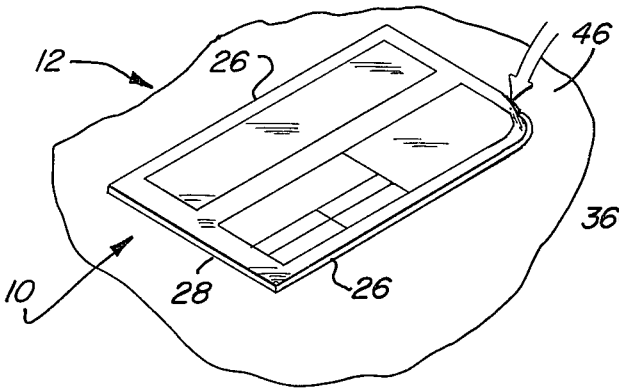
FIG. 6 is a perspective view of the envelope mounted on a package with a corner bent out or bulged in the course of opening.

While the adhesive may cover the entire exterior face 18 of the flap it is presently preferred to apply it only to the free edge half or a portion of the flap as shown with the length of the adhesive areas 35 corresponding. Thus, it is possible to bulge the end of the fold edge in or to curl or turn a corner 46 up as shown in FIG. 6 to facilitate insertion of a cutting instrument to sever the flap at the fold line or to pull the flap up and free of the package for opening.

As best seen in FIGS. 2 and 5, the side edges 48 of flap 32 are formed to converge inwardly from the fold line to the free edge. Thus, the adhesive areas 35 seal the edges of the flap 32 and prevent loss of the package contents.

It will also be noted as shown in FIG. 2 that the second end portion 30 of panel 20 is free of adhesive over a longitudinal extent greater than the longitudinal extent of flap 32. Thus, when the envelope is fully secured, there will still be a non-adhered area or gap 50 along the edge between the envelope and the package into which an instrument may be inserted to pry the folded portion of the flap loose from the package.

What is claimed is:

1. A shipping envelope for containing packing sheets and the like, comprising:

a forward panel and a rear panel closed along their side edges and along a first bottom end edge, with their second ends free of each other to provide access to the interior;

each panel having an interior face and an exterior face;

the forward panel being substantially longer than the rear panel;

the excess length of the forward panel constituting a flap foldable over the rear panel and the mouth of the envelope to serve as a closure, a fold line being formed between the flap and the forward panel;

a first area of adhesive on a major part of the exterior face of the rear panel;

a second area of adhesive on at least a portion of the exterior face of the flap;

and release sheets overlying the adhesive areas of the flap and the rear panel;

the release sheet on the rear panel being removable to facilitate attachment of the envelope to a package with the mouth of the envelope open to receive shipping documents;

and the release sheet on the flap being removable to facilitate folding the flap over and under the mouth of the envelope and attachment of the exterior face of the flap to the package.

2. An envelope as claimed in claim 1; in which the second adhesive area extends only along the free edge portion of the flap to facilitate raising the corner of the envelope and inserting a cutting instrument to sever the flap along the fold line.

3. An envelope as claimed in claim 1; in which the side edges of the flap are formed to converge inwardly from the fold line to the free edge and adhesive areas along each edge of the flap are applied to the rear panel to hold the corners against a package and aid in sealing the contents of the envelope.

4. An envelope as claimed in claim 1; in which the first adhesive area on the exterior face of the rear panel is omitted along the marginal portions so that the edges of the envelope can raise to permit expansion of the interior of the envelope for the insertion of the documents.

5. A method of attaching and utilizing a shipping envelope, comprising:

providing an envelope having forward and rear panels closed at the sides and at a first end and open at the second end, with a flap in continuation of the forward panel and with adhesive on the outer face of the flap and on the major part of the outer face of the rear panel;

pressing the adhesive face of the rear panel into securing relation with the surface of a package;

inserting at least one shipping document through the open mouth of the envelope;

folding the flap over and under the open mouth of the envelope to serve as a closure;

and pressing the adhesive outer face of the flap into securing relation with the surface of the package.

* * * * *